US011583100B2

(12) United States Patent
Langer

(10) Patent No.: US 11,583,100 B2
(45) Date of Patent: Feb. 21, 2023

(54) CUSTOMIZABLE PRESSURE OFFLOADING CUSHIONING DEVICE WITH VARIABLE FLEXIBILITY

(71) Applicant: GLOBAL MEDICAL FOAM, INC., Lexington, OH (US)

(72) Inventor: Victoria A. Langer, Lexington, OH (US)

(73) Assignee: GLOBAL MEDICAL FOAM, INC., Lexington, OH (US)

( * ) Notice: Subject to any disclaimer, the term of this patent is extended or adjusted under 35 U.S.C. 154(b) by 160 days.

(21) Appl. No.: 17/017,796

(22) Filed: Sep. 11, 2020

(65) Prior Publication Data

US 2021/0068556 A1 Mar. 11, 2021

Related U.S. Application Data

(60) Provisional application No. 62/898,918, filed on Sep. 11, 2019.

(51) Int. Cl.

| | |
|---|---|
| ***A47C 27/14*** | (2006.01) |
| ***A61G 7/07*** | (2006.01) |
| ***A61G 7/057*** | (2006.01) |

(52) U.S. Cl.

CPC ..... *A47C 27/142* (2013.01); *A61G 7/05723* (2013.01); *A61G 7/07* (2013.01)

(58) Field of Classification Search

CPC ..... A47C 27/142; A47C 27/146; A61G 7/07; A61G 5/1043; A61G 5/1045; A61G 7/05707; A61G 5/1091; A61G 7/05715; A61G 7/05723; A61G 7/05784; A61G 2013/00404; A61F 15/008; A61F 2013/00404

See application file for complete search history.

(56) References Cited

U.S. PATENT DOCUMENTS

| | | | | |
|---|---|---|---|---|
| 5,038,433 | A | 8/1991 | Farley | |
| 5,459,896 | A | 10/1995 | Raburn et al. | |
| 6,360,388 | B2 | 3/2002 | Langer | |
| 6,625,830 | B2 | 9/2003 | Lampel | |
| 7,146,666 | B2 | 12/2006 | Christofferson et al. | |
| 2004/0147863 | A1* | 7/2004 | Diaz | A61F 15/008 602/41 |
| 2008/0074812 | A1 | 3/2008 | Oestreich et al. | |

* cited by examiner

*Primary Examiner* — David R Hare
*Assistant Examiner* — Madison Emanski
(74) *Attorney, Agent, or Firm* — Jacob M. Ward; Ward Law Office LLC

(57) ABSTRACT

A customizable cushioning device for supporting an anatomical region of a patient can include a main body. The main body can have an intact base and a plurality of removable pillars. The plurality of removable pillars can be disposed on the intact base. The main body can include a first portion and a second portion. The first portion can have a first flexibility. The second portion can have a second flexibility. The first flexibility is different from the second flexibility.

16 Claims, 6 Drawing Sheets

CUSTOMIZABLE PRESSURE OFFLOADING CUSHIONING DEVICE WITH VARIABLE FLEXIBILITY

CROSS-REFERENCE TO RELATED APPLICATIONS

This application claims the benefit of U.S. Provisional Application No. 62/898,918, filed on Sep. 11, 2019. The entire disclosure of the above application is incorporated herein by reference.

FIELD

The present disclosure relates to a medical supporting device, more particularly, to a medical supporting device that supports or positions an anatomical region of a patient.

INTRODUCTION

The nervous system of humans and animals is uniquely developed to perceive sensations that present a risk of harm to the body. One of those threats is prolonged pressure at a point of contact. Prolonged pressure or point pressure loading on tissues is uncomfortable and can be painful. The transmission of a signal of discomfort or pain to the brain stimulates a counter signal from the brain to the skeletal muscles calling for some movement. This movement is intended to alleviate the pressure.

Prolonged point loading is deleterious and can lead to significant tissue damage and, in some cases, life-threatening injuries. Gravity places forces on the body to generate the sensation of mass. Bony protrusions such as the point of the elbow, back of the head, hips, and knees are just some examples of places that typically end up being prominent contact points counteracting the force of gravity depending upon the position of the body. If the nervous system does not sense, or the body is unable to respond to the signals of prolonged pressure, an adverse situation can arise.

Prolonged pressure can have a profound effect on the soft tissues. When blood vessels, muscle, subcutaneous fat, and skin are compressed between bone and an external surface, such compression can compromise the normal functions of the compressed area. The greatest tissue destruction can be beneath the skin surface at the bony interface. If left undisturbed, decreased circulation to the area can drive the oxygen tension of the region into a state of hypoxia and eventually necrosis. The necrotic area can then rupture into a wound that begins inside the body and erodes to the outside. These are often referred to as "pressure injuries" (NPUAP, National Pressure Ulcer Advisory Panel).

A wide variety of medical supports and methods have been developed to prevent or alleviate pressure injuries. For example, a cushioning device and method is disclosed in Applicant's co-pending application, U.S. application Ser. No. 16/451,320 that can militate against a pressure injury. However, further improvements to the art can still be made. For instance, medical supports can be undesirably stiff or rigid, which can result in poor optimized pressure redistribution. In addition, medical supports can undesirably become contaminated during use.

There is a continuing need for a customizable cushioning device that has a variable flexibility for optimized pressure redistribution. Desirably, the customizable cushioning device can militate against cross-contamination between uses.

SUMMARY

In concordance with the instant disclosure, a customizable cushioning device that has a variable flexibility for optimized pressure redistribution, and which can militate against cross-contamination between uses, has been surprisingly discovered.

The present disclosure can be adapted to provide support, restrict motion, offload pressure, and provide pressure redistribution for different anatomical regions of the human body.

In one embodiment, a customizable cushioning device for supporting an anatomical region of a patient can include a main body. The main body can have an intact base and a plurality of removable pillars. The plurality of removable pillars can be disposed on the intact base. The main body can include a first portion and a second portion. The first portion can have a first flexibility. The second portion can have a second flexibility. The first flexibility can be different from the second flexibility.

In another embodiment, a method for supporting an anatomical region of a patient includes providing the customizable cushioning device. A portion of the plurality of removable pillars are removed from the customizable cushion device to form a conforming depression in the plurality of removable pillars. The conforming depression can be configured to accommodate contours of the anatomical region of the patient.

DRAWINGS

The above, as well as other advantages of the present disclosure, will become readily apparent to those skilled in the art from the following detailed description, particularly when considered in the light of the drawings described herein.

DETAILED DESCRIPTION

Figure 1:
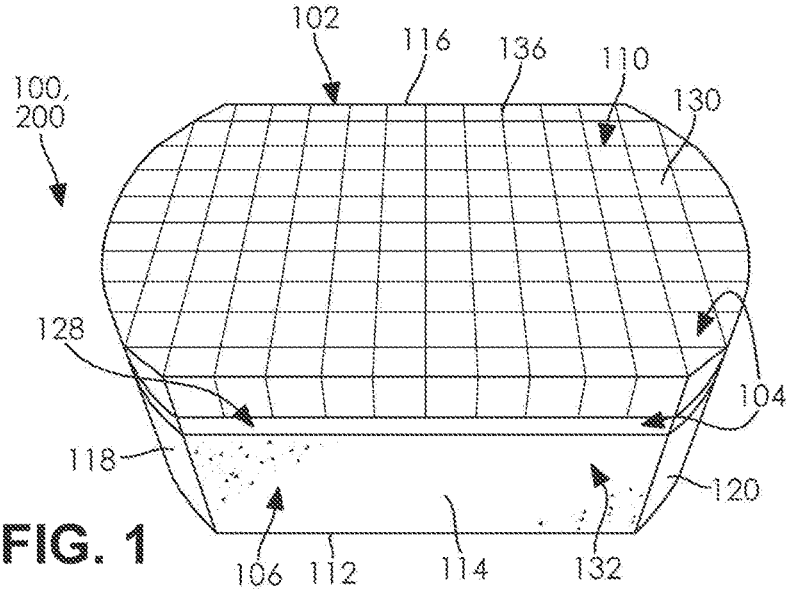
FIG. 1 is a top perspective view of a customized cushioning device as a prone head support, according to one embodiment of the present disclosure, and further showing a plurality of removable pillars, a backing layer, and an intact base.

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

When an element or layer is referred to as being "on," "engaged to," "connected to," or "coupled to" another element or layer, it can be directly on, engaged, connected or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

As herein, the term "anatomical region" can include regions of the head, chest, pelvis, legs, posterior, arms, and legs. However, it should be appreciated that other regions are contemplated and can therefore be included within the scope of this disclosure.

With reference to FIGS. 1-13, a customizable cushioning device 100 is shown. The customizable cushioning device 100 can be configured to provide support and pressure redistribution for an anatomical region 101 of a patient. The customizable cushioning device 100 can include a main body 102. The main body 102 can be formed from a material capable of bending and flexing. In specific examples, the main body 102 can be formed from foam. The foam can comprise one or more of polyurethane foam, viscoelastic foam, memory foam such as viscoelastic polyurethane foam, polyvinyl foam, natural foam rubber, and synthetic foam rubber. However, it should be appreciated that a skilled artisan can select foams comprising of different materials, within the scope of this disclosure.

While still referring to FIGS. 1-13, the main body 102 can include a first portion 104 and a second portion 106. The first portion 104 and the second portion 106 can be conformed together during the manufacturing process. However, it should be appreciated that the first portion 104 and the second portion 106 can be formed separately and affixed together. For example, a layer of adhesive 108 can be disposed between the first portion 104 of the main body 102 and the second portion 106 of the main body 102, thereby affixing them together, as shown in FIG. 5. In specific examples, a spray hot-melt adhesive can used to affix the first portion 104 of the main body 102 to the second portion 106 of the main body 102. The spray hot-melt adhesive can be based on synthetic polymers, such as amorphous poly alpha olefins, ethylene-vinyl acetate, and styrene-isoprene-styrene. In even more specific examples, the spray hot-melt adhesive is one of the SABA™ foam adhesives. Another example can include hot welding the first portion 104 of the main body 102 and the second portion 106 of the main body 102 together. However, it should be appreciated that one skilled in the art can select other methods of manufacturing and affixing the first portion 104 of the main body 102 to the second portion 106 of the main body 102, as desired.

The first portion 104 can have a first flexibility, a first density, and a first indentation force-deflection (IFD). The second portion 106 can have a second flexibility, a second density, and a second IFD. The first flexibility can be different than the second flexibility. In particular examples, the first flexibility of the first portion 104 can be greater than the second flexibility of the second portion 106. Different flexibilities can result from different densities, in certain embodiments. For example, for a given material the density can be varied to produce different flexibilities, where a lower density can result in a higher flexibility in certain instances. It should also be appreciated that the first portion 104 can be manufactured from a different material than the second portion 106 of the main body. Desirably, the first flexibility being a higher flexibility can provide pressure redistribution for the anatomical region 101 when disposed upon the first portion 104 of the main body 102. In addition, the second flexibility being a lower flexibility can provide overall support for the customizable cushioning device 100 as a whole. In some cases, at least one of the first portion 104 and the second portion 106 of the main body 102 can include a memory foam, which can further result in a more comfortable experience for the patient. In addition, the first flexibility and the second flexibility can be altered by changing at least one of the material of the first portion and the second portion, the first density, the second density, the first IFD, and the second IFD. The first IFD and the second IFD are determined based on the standard test method for testing flexible cellular materials, as described in ASTM D5672/D5672M-15, Standard Test Method for Testing Flexible Cellular Materials Measurement of Indentation Force Deflection Using a 25-mm [1-in.] Deflection Technique, ASTM International, West Conshohocken, Pa., 2015, the entire disclosure of which is incorporated herein by reference. It should be appreciated that a skilled artisan can scale the flexibility of the first flexibility and the second flexibility by altering other qualities and characteristics of the main body 102, within the scope of this disclosure.

As will be discussed in further details below, the main body 102 can formed into different shapes and sizes to accommodate various anatomical regions 101 of different sizes and types. The main body 102 can be formed using vertical sawing, tilt sawing, computer numerical control (CNC) contour cutting machines, slitting machines, and wire cutting machines. For example, the customizable cushioning device 100 can be shaped to align and correspond to a wheelchair seat. Desirably, this permits the customizable cushioning device 100 to receive and support the anatomical region 101, such as the buttock, when the patient is sitting in a wheelchair. It should be appreciated that a skilled artisan can select different shapes and sizes for the customizable cushioning device 100, depending on its intended end use.

With reference to FIG. 1, the main body 102 can include top surface 110, bottom surface 112, left side 114, right side 116, rear side 118, and a front side 120. The main body 102 can further include a main body height 122 (shown in FIG. 7), a main body width 124 (shown in FIG. 10), and a main body length 126 (shown in FIG. 10). The main body height 122 can be defined by a distance between the bottom surface 112 and the top surface 110. The main body width 124 can be defined by a distance between the right side 116 and the left side 114. The main body length can be defined by a distance between the rear side 118 and the front side 120.

Figure 13:
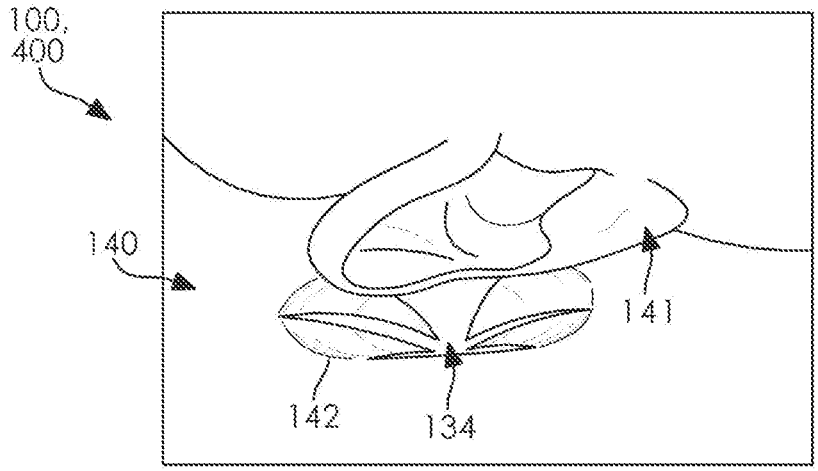
FIG. 13 is an enlarged view of the head support taken at call-out B in FIG. 12, and further showing an anatomical region of a patient being lowered into the conforming depression.
Figure 14:
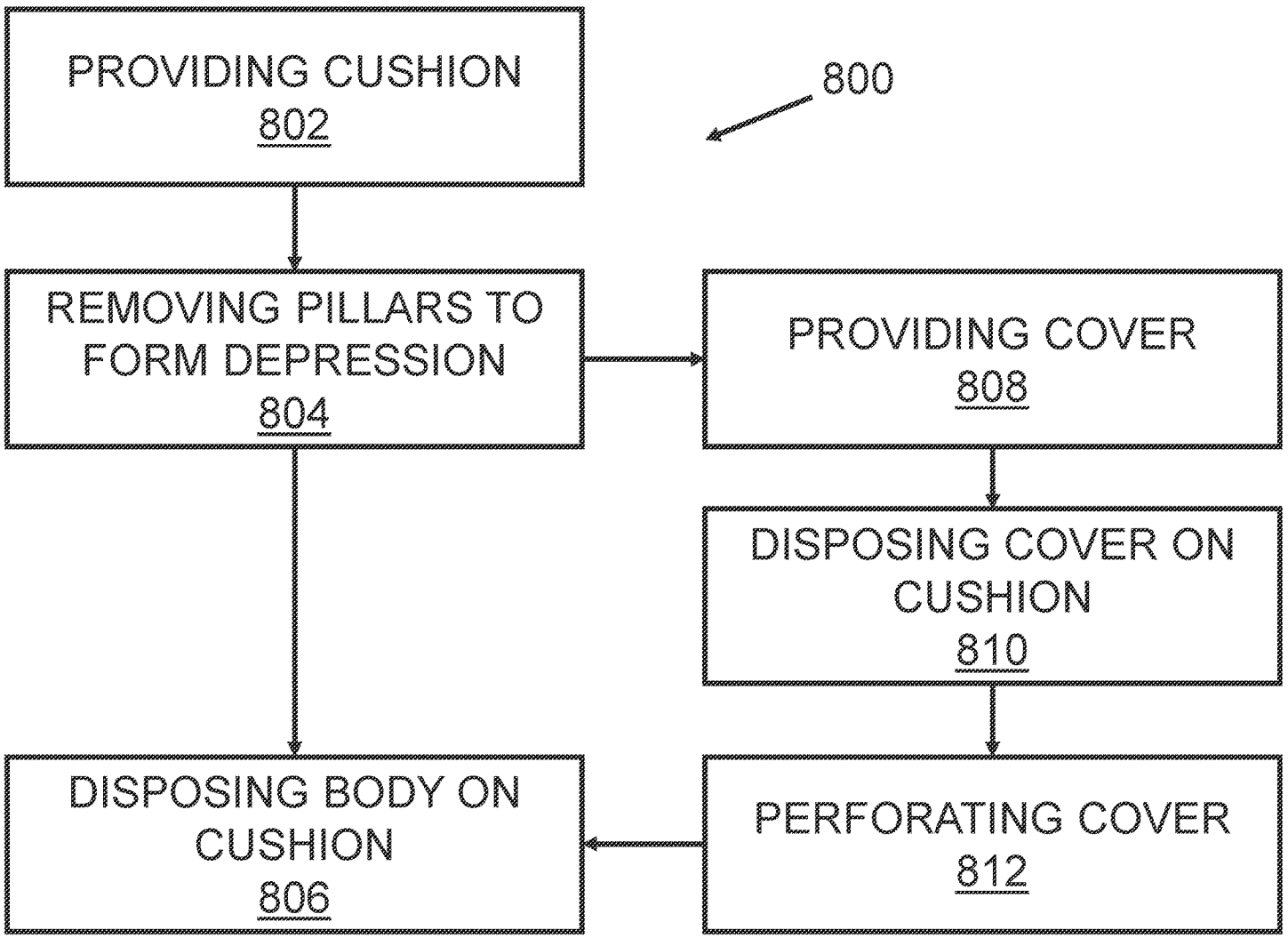
FIG. 14 is a flowchart showing a method for supporting the anatomical region of the patient.

Now referring again to FIG. 1, the main body 102 can include an intact base 128, a plurality of removable pillars 130, and a backing layer 132. The intact base 128 and the plurality of removable pillars 130 can have the structures and functions as described in U.S. application Ser. No. 16/451,320, the entire disclosure of which is incorporated herein by reference. The intact base 128 can provide support for the plurality of removable pillars 130. The plurality of removable pillars 130 can be configured to be removed to form a conforming depression 134, as shown in FIG. 13. The conforming depression 134 can be configured to accommodate contours of the anatomical region 101 of the patient. Desirably, it is believed that conforming depression 134 can provide support and pressure redistribution for the anatomical region 101 of the patient.

With reference to FIG. 1, the plurality of removable pillars 130 can be formed on the main body 102 by a lattice of cuts 136. The lattice of cuts 136 can extend downwardly and terminate at the intact base 128. The lattice of cuts 136 can be formed manually, by mechanical cutting, or during the molding process of the main body 102. However, it should be appreciated that a skilled artisan can employ other methods and processes to form the lattice of cuts 136, as desired.

In specific examples, the lattice of cuts 136 extend downwardly by 51% to 99% of the main body height 122. In even more specific examples, the lattice of cuts 136 extend downwardly by 60% to 95% of the main body height 122. It should be appreciated that one skilled in the art can scale how far the lattice of cuts 136 extend downwardly, as desired.

Each of the removable pillars can have a cross-sectional area. In specific examples, the cross-sectional area can be from one tenth square centimeter (0.1 $cm^2$) square to one hundred square centimeter (100 $cm^2$). In more specific examples, the cross-sectional area can be from one half square centimeter (0.5 $cm^2$) to sixteen square centimeters (16 $cm^2$). In even more specific examples, the cross-sectional area can be from one square centimeter (1 $cm^2$) to two square centimeters (2 $cm^2$). However, it should be appreciated that one skilled in the art can select different dimensions for the cross-sectional area of each of the removable pillars, within the scope of this disclosure.

With reference to FIG. 13, a portion of the removable pillars 130 can be configured to be removed to form the conforming depression 134 by tearing away each of the removable pillars 130 of the portion. This can involve pinching and pulling each of the removable pillars 130 of the portion by a user. However, each of the removable pillars 130 of the portion can also be removed by cutting them from the intact base 128 using scissors. It should be appreciated that a skilled artisan can employ other methods of removing the portion of the removable pillars 130, as desired. Desirably, this can permit the conforming depression 134 to be customizable by the user and conform to the anatomical region 101 of the patient. In addition, the portion of the removable pillars 130 can be removed at the intact base 128. However, the portion of removable pillars 130 can also be partially removed at a location between the intact base 128 and the top surface 110 of the main body 102, according to the needs of the patient.

Figure 7:
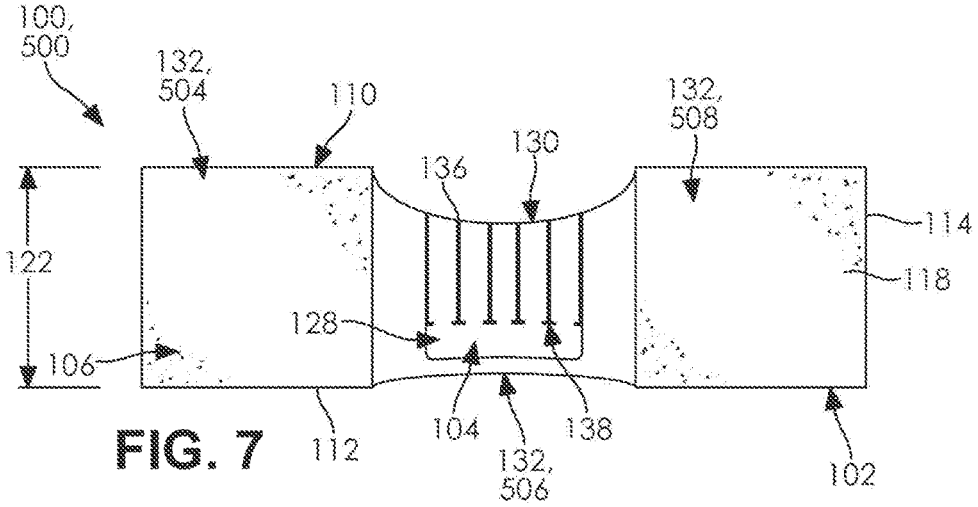
FIG. 7 is a rear elevational view of the lower torso support shown in FIG. 6, and further showing each of the removable pillars having a cross-cut.

Now referencing FIG. 7, each of the removable pillars 130 can include one or more cross-cuts 138 directly adjacent to the intact base 128. Specifically, each cross-cut 138 can include a first cut and a second cut. Each of the first cut and the second cut can be located adjacent to the intact base 128 and parallel to the intact base 128. Desirably, the cross-cut 138 permits each of the removable pillars 130 to be easily pinched and pulled off the intact base 128 by the user. It should be appreciated that one skilled in the art can employ other types of partial cuts to remove the portion of the removable pillars 130, within the scope of this disclosure.

As shown in FIG. 7, the backing layer 132 can be configured to militate against the anatomical region 101 of the patient from sinking into the backing layer 132, which can thereby hold the anatomical region 101 into a substantially fixed position. The backing layer 132 can be disposed underneath the plurality of removable pillars 130. Advantageously, the backing layer 132 assists in supporting the anatomical region 101 into the fixed position. However, it should be appreciated that there can be instances where the backing layer 132 is not disposed underneath the plurality of removable pillars 130.

Figure 10:
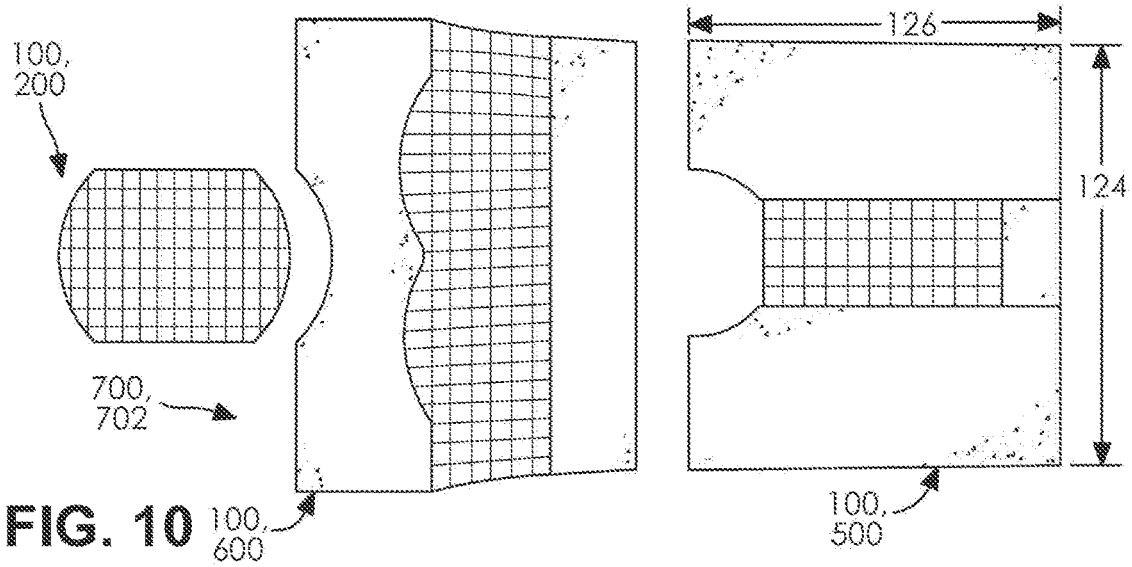
FIG. 10 is a top plan view of a prone positioning kit having the prone head support of FIG. 1, the upper torso support of FIGS. 8-9, and the lower torso support of FIGS. 6-7 arranged in a prone configuration.

As shown in FIGS. 1 and 10, a first embodiment of the customizable cushioning device 100 as a prone head support 200. The prone head support 200 can be configured to receive and support the anatomical region 101 of the patient, such as the face, when the patient is in a prone position. The top surface 110 of the prone head support 200 can be defined by the plurality of removable pillars 130. Advantageously, this can permit the majority of the face of the patient to be received and supported by the plurality of removable pillars 130. The front side 120 and the rear side 118 of the prone head support 200 can also be rounded. Desirably, this can assist in conforming the prone head support 200 to the face of the patient.

The plurality of removable pillars 130 of the prone head support 200 can be formed from the first portion 104 of the main body 102. The backing layer 132 can be formed from the second portion 106 of the main body 102. The first flexibility of the first portion 104 can be greater than the second flexibility of the second portion 106 of the main body 102. Desirably, having the first portion 104 be a greater flexibility can provide pressure redistribution for the anatomical region 101 of the patient. In addition, it is believed the higher flexibility of the first portion 104 of the main body 102 can assist the plurality of removable pillars 130 to conform to the contours of the anatomical region 101. It should be appreciated that the first flexibility and the second flexibility can be scaled according to the patient. For example, the flexibility values can change if the patient is an adult or a newborn.

In particular examples, the first IFD can be from 5 lbf to 35 lbf and the second IFD can be from 22 lbf to 48 lbf. The first density can be from 2.9 $lb/ft^3$ to 5.1 $lb/ft^3$ and the second density can be from 0.1 $lb/ft^3$ to 2.3 $lb/ft^3$. In more particular examples, the first IFD can be from 10 lbf to 30 lbf and the second IFD can be from 27 lbf to 43 lbf. The first density can be from 3.4 $lb/ft^3$ to 4.6 $lb/ft^3$ and the second density can be from 0.6 $lb/ft^3$ to 1.8 $lb/ft^3$. In even more particular examples, the first IFD can be from 15 lbf to 25 lbf and the second IFD can be from 32 lbf to 38 lbf. The first density can be from 3.9 $lb/ft^3$ to 4.1 $lb/ft^3$ and the second density can be from 1.1 $lb/ft^3$ to 1.3 $lb/ft^3$. It should be appreciated that one skilled in the art can scale the first IFD, the second IFD, the first density, and the second density, as desired.

In some examples, the main body length of the prone head support 200 can be about 14.5". The main body height 122 can be about 5". The main body width 124 can be about 9.5". However, it should be appreciated that a skilled artisan can select other dimensions for the prone head support 200, according to the shape and size of the head of the patient. It should be also appreciated that at least one of the first portion 104 and the second portion 106 of the main body 102 can be comprised of memory foam, such as visco elastic foam.

Figure 2:
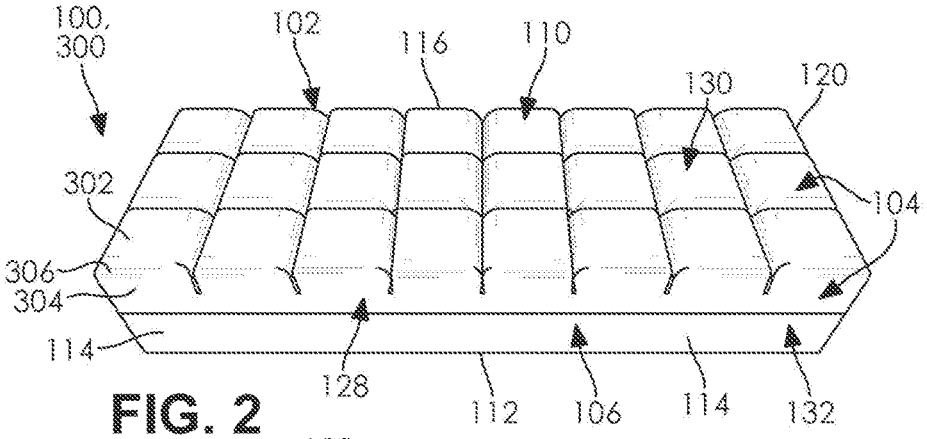
FIG. 2 is a top perspective view of the customized cushioning device as a cushion, according to another embodiment, and further showing each of the removable pillars having a top pillar surface, a side pillar surface, and a rounded pillar transition.

Now referring to FIG. 2, a second embodiment of the customizable cushioning device 100 as a cushion 300 is shown. The cushion 300 can be configured to receive and support the anatomical region 101 of the patient, such as the buttock, when the patient is sitting on the cushion 300. The top surface 110 of the cushion 300 can be defined by the plurality of removable pillars 130. Desirably, this can permit the majority of the buttock to be received and supported by the plurality of removable pillars 130.

Each of the plurality of removable pillars 130 of the cushion 300 can have a top pillar surface 302, a side pillar surface 304, and a rounded pillar transition 306. The rounded pillar transition 306 can be disposed between the top pillar surface 302 and the side pillar surface 304. It is believed, without being bound to a particular theory, that the rounded pillar transition 306 can permit optimized pressure redistribution. In addition, it is believed that the rounded pillar transition 306 can permit each of the removable pillars 130 to more easily return back to an original position without catching on adjacent pillars 130 after being compressed during operation.

The plurality of removable pillars 130 of the cushion 300 can be formed from the first portion 104 of the main body 102. The backing layer 132 can be formed from the second portion 106 of the main body 102. The first flexibility of the first portion 104 can be greater than the second flexibility of the second portion 106. Desirably, the first portion 104 of the main body 102 having higher flexibility can provide pressure redistribution for the anatomical region 101 of the patient. In addition, it is believed the higher flexibility of the first portion 104 can assist the plurality of removable pillars 130 to conform to the contours of the anatomical region 101. It should be appreciated that the first flexibility and the second flexibility can be scaled according to the patient. For example, the flexibility values can change if the patient is an adult or a newborn.

In specific examples, the first IFD and the second IFD can be from 5 lbf to 80 lbf. The first density and the second density can be from 0.1 lb/ft$^3$ to 5 lb/ft$^3$. In more specific examples, the first IFD and the second IFD can be from 10 lbf to 75 lbf. The first density and the second density can be from 0.6 lb/ft$^3$ to 4.5 lb/ft$^3$. In even more specific examples, the first IFD and the second IFD can be from 15 lbf to 70 lbf. The first density and the second density can be from 1.10 lb/ft$^3$ to 4.0 lb/ft$^3$. It should be appreciated that one skilled in the art can scale the first IFD, the second IFD, the first density, and the second density, as desired.

Figure 3:
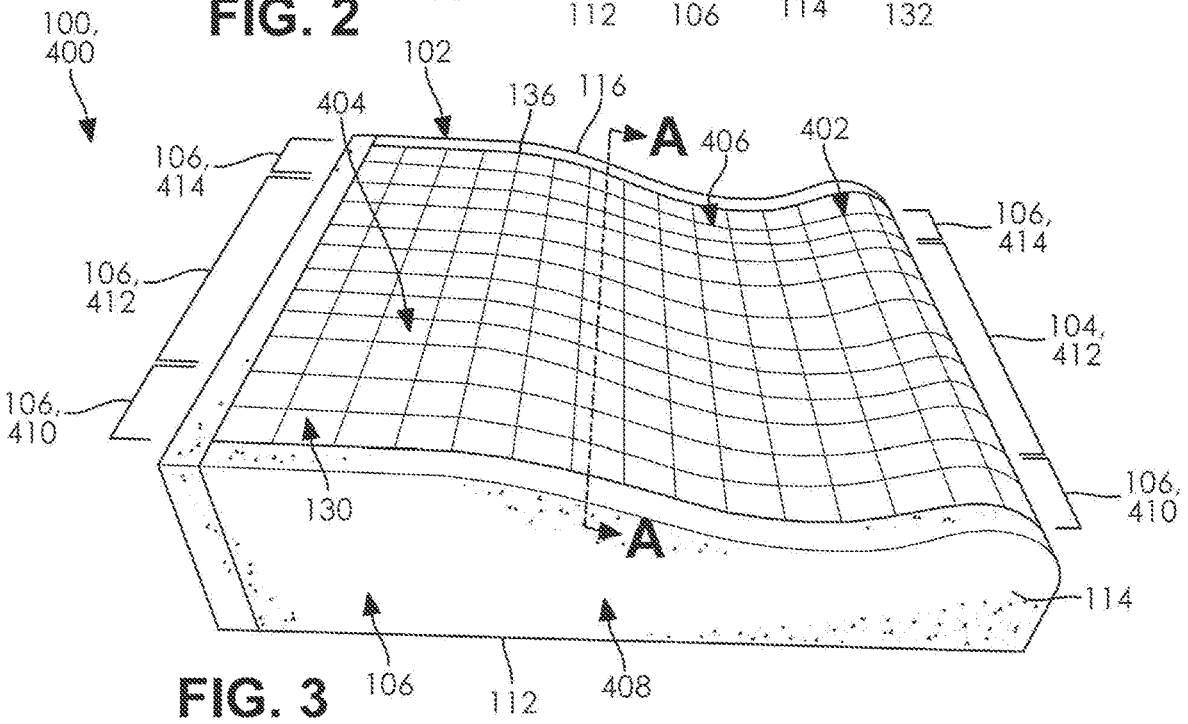
FIG. 3 is a top perspective view of the customized cushioning device as a head support, according to a further embodiment, and further showing the plurality of removable pillars and a frame.
Figure 4:
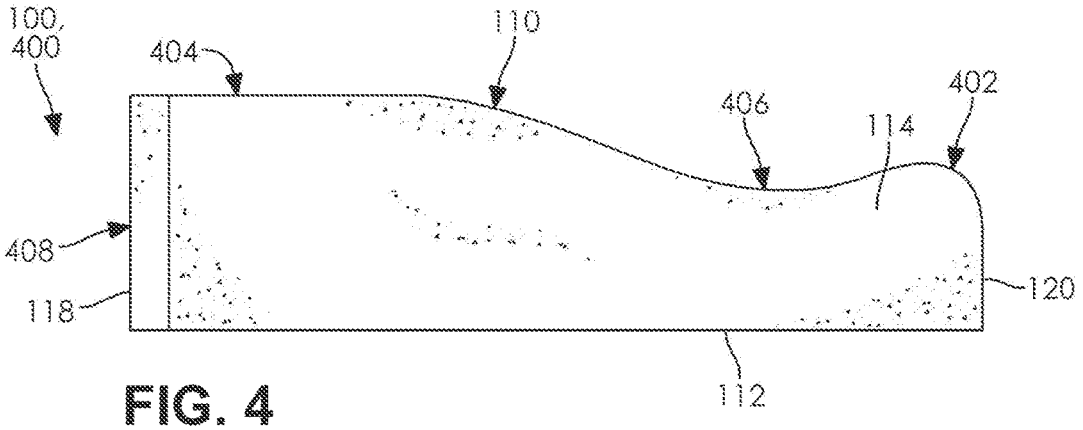
FIG. 4 is a left side elevational view of the head support shown in FIG. 3, and further showing a leveled portion, a slope portion, and a rounded portion.
Figure 5:
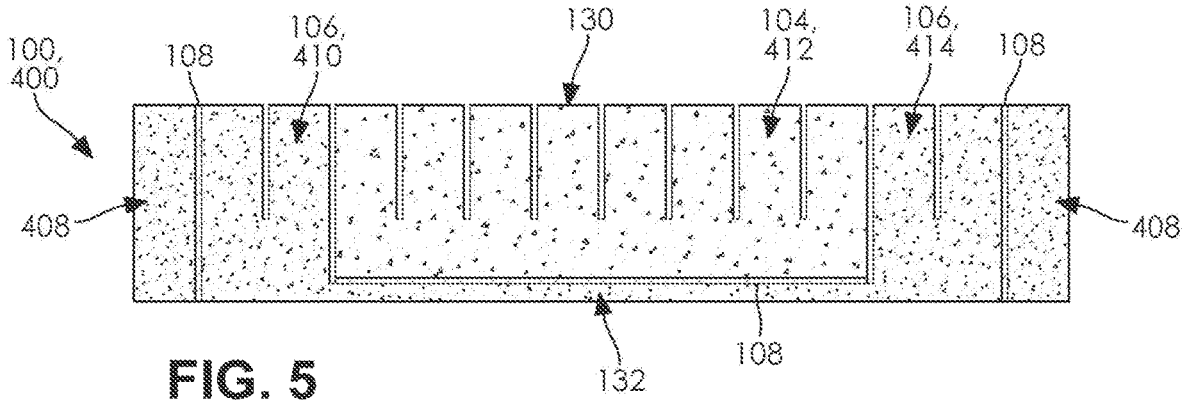
FIG. 5 is a cross sectional view of the head support taken at section line A-A in FIG. 3, and further showing the plurality of removable pillars, the intact base, the backing layer, and the layer of adhesive.

With reference to FIGS. 3-5, a third embodiment of the customizable cushioning device 100 as a head support 400 is shown. The head support 400 can be configured to receive and support the anatomical region 101 of the patient, such as the head, when the patient is in a supine position. A majority of the top surface 110 of the main body 102 can be defined by the plurality of removable pillars 130.

The plurality of removable pillars 130 of the head support 400 can include a rounded portion 402, a leveled portion 404 and a slope portion 406. The rounded portion 402 can be disposed adjacent to the front side 120. The rounded portion 402 can be configured to receive and support a neck of the patient. Desirably, the rounded portion 402 can conform to the contours of the lower head of the patient, which is adjacent to the neck. The leveled portion 404 can be disposed adjacent to rear side 118 of the main body 102. The leveled portion 404 can be configured to receive and support the upper portions of the head of the patient. The slope portion 406 can be disposed between the leveled portion 404 and the rounded portion 402. The slope portion 406 can be configured to receive and support at least one of the head, an ear, and a side of the head of the patient.

The main body 102 of the head support 400 can further include a frame 408. The frame 408 can be configured to partially surround the main body 102. In particular examples, the frame 408 can surround the rear side 118, the left side 114, and the right side 116 of the main body 102. The frame 408 can also be configured to support the plurality of removable pillars 130 and militate against the plurality of removable pillars 130 from bending past the frame 408.

The plurality of removable pillars 130 of the head support 400 can include a left region 410, a middle region 412, and a right region 414. The middle region can be disposed between the left region 410 and the right region 414. The middle region can be formed from the first portion 104 of the main body 102. Each of the left region 410, the right region 414, the backing layer 132, and the frame 408 can be formed from the second portion 106 of the main body 102. The first flexibility of the first portion 104 can be greater than the flexibility of the second portion 106. Desirably, the high flexibility of the first portion 104 can provide pressure redistribution for the anatomical region 101 of the patient. In addition, it is believed the high flexibility of the first portion 104 can assist the plurality of removable pillars 130 to conform to the contours of the anatomical region 101. It should be appreciated that the first flexibility and the second flexibility can be scaled according to the patient. For example, the flexibility values can change if the patient is an adult or a newborn. Also, it is believed that having the second flexibility be lower can assist the left region 410 and the right region 414 in supporting the middle region. In addition, the lower flexibility of the left region 410 and the right region 414 can militate against the plurality of removable pillars 130 of the middle region from bending substantially past the right region 414 and the left region 410.

In specific examples, the first IFD can be from 7 lbf to 33 lbf and the second IFD can be from 22 lbf to 48 lbf. The first density can be from 0.7 lb/ft$^3$ to 2.9 lb/ft$^3$ and the second density can be from 0.1 lb/ft$^3$ to 2.3 lb/ft$^3$. In more specific examples, the first IFD can be from 12 lbf to 28 lbf and the second IFD can be from 27 lbf to 43 lbf. The first density can be from 1.2 lb/ft$^3$ to 2.4 lb/ft$^3$ and the second density can be from 0.6 lb/ft$^3$ to 1.8 lb/ft$^3$. In even more specific examples, the first IFD can be from 17 lbf to 23 lbf and the second IFD can be from 32 lbf to 38 lbf. The first density can be from 1.7 lb/ft$^3$ to 1.9 lb/ft$^3$ and the second density can be from 1.1 lb/ft$^3$ to 1.3 lb/ft$^3$. It should be appreciated that one skilled in the art can scale the first IFD, the second IFD, the first density, and the second density, as desired.

Figure 6:
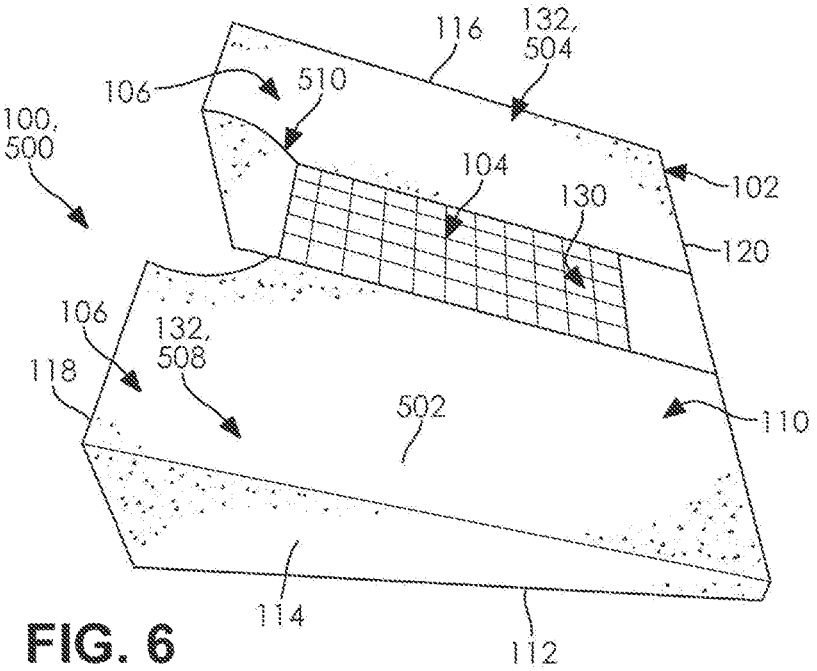
FIG. 6 is a top perspective view of the customized cushioning device as a lower torso support, according to another embodiment, and further showing a lower torso void formed on a rear side of the main body.

Now referring to FIGS. 6-7 and 10, a fourth embodiment of the customizable cushioning device 100 as a lower torso support 500 is shown. The lower torso support 500 can be configured to support and receive the anatomical region 101 of the patient, such as a lower torso of the patient, when the patient is in the supine position. In particular, the plurality of removable pillars 130 can be configured to receive and support genitals of the patient.

The main body 102 of the lower torso support 500 can have a wedge shape with a lower torso incline 502. Desirably, the wedge shape and the lower torso incline 502 orientate the lower torso of the patient to permit pressure redistribution. The backing layer 132 can have a first backing region 504, a second backing region 506, and a third backing region 508. The first backing region 504 can be disposed adjacent to the right side 116 of the main body 102. The third backing region 508 can be disposed adjacent to the left side 114 of the main body 102. The second backing region 506 can be disposed between the first backing region 504 and the third backing region 508. The second backing region 506 can be disposed underneath the plurality of removable pillars 130. Each of the first backing region 504 and the third backing region 508 is not disposed underneath the plurality of removable pillars 130. The top surface 110 can be defined by the first backing region 504, the third backing region 508, and the plurality of removable pillars 130. The lower torso incline 502 can be formed in the top surface 110. The lower torso incline 502 can provide an increasing thickness from the front side 120 to the rear side 118 of the main body 102.

The first backing region 504, the third backing region 508, and the rear side 118 of the main body 102 can include a lower torso void 510. It is believed without being bound to a particular theory that the lower torso void 510 can permit the diaphragm of the patient to expand and ease breathing. In some examples, the lower torso void 510 can be shaped like a half-circle. However, it should be appreciated that the lower torso void 510 can be shaped differently, within the scope of this disclosure.

The plurality of removable pillars 130 can be formed from the first portion 104 of the main body 102. Each of the first backing region 504, the second banking region, and the third backing region 508 can be formed from the second portion 106 of the main body 102. The first flexibility of the first portion 104 can be greater than the second flexibility of the second portion 106. Desirably, the first flexibility being a higher flexibility can provide pressure redistribution for the anatomical region 101 of the patient. Also, it is believed that having the first backing region 504 and the third backing region 508 be a lower flexibility can assist the first backing region 504 and the third backing region 508 in supporting the plurality of removable pillars 130. In addition, the low flexibility of the first backing region 504 and the third backing region 508 can militate against the plurality of removable pillars 130 disposed on the middle region from bending substantially past the first backing region 504 and the third backing region 508.

In specific examples, the first IFD can be from 7 lbf to 33 lbf and the second IFD can be from 22 lbf to 85 lbf. The first density can be from 0.1 lb/ft$^3$ to 2.3 lb/ft$^3$ and the second density can be from 1.9 lb/ft$^3$ to 4.1 lb/ft$^3$. In more specific examples, the first IFD can be from 12 lbf to 28 lbf and the second IFD can be from 32 lbf to 75 lbf. The first density can be from 0.6 lb/ft$^3$ to 1.8 lb/ft$^3$ and the second density can be from 2.4 lb/ft$^3$ to 3.6 lb/ft$^3$. In even more specific examples, the first IFD can be from 17 lbf to 23 lbf and the second IFD can be from 38 lbf to 65 lbf. The first density can be from 1.1 lb/ft$^3$ to 1.3 lb/ft$^3$ and the second density can be from 2.9 lb/ft$^3$ to 3.1 lb/ft$^3$. It should be appreciated that one skilled in the art can scale the first IFD, the second IFD, the first density, and the second density, as desired.

Figure 8:
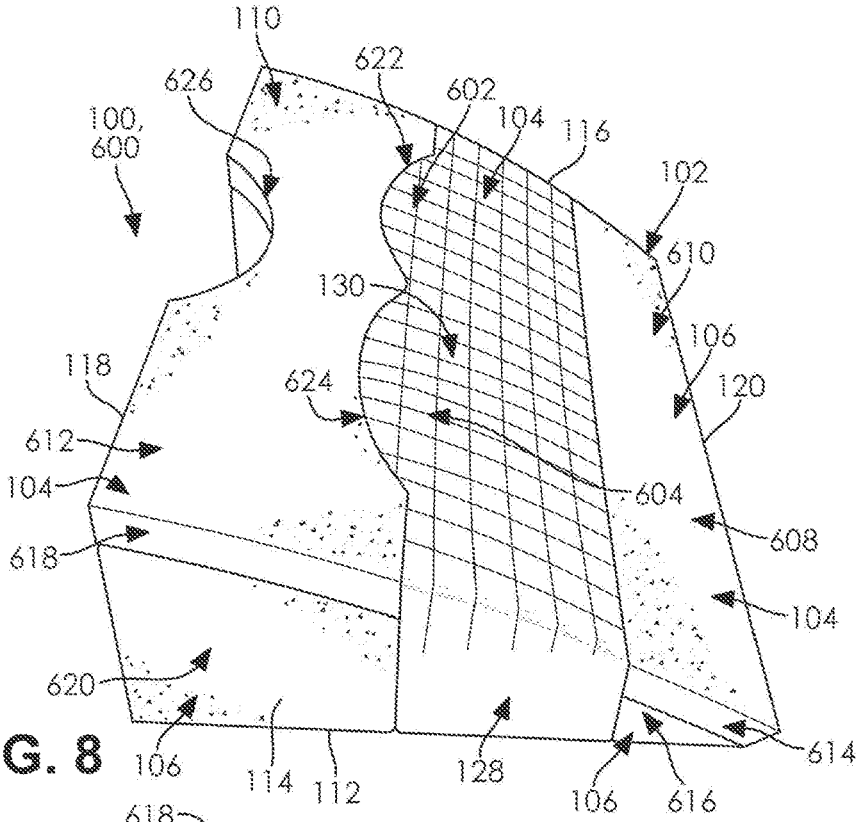
FIG. 8 is a top perspective view of the customized cushioning device as an upper torso support, according to a further embodiment, and further showing a first supporting structure and a second supporting structure.
Figure 9:
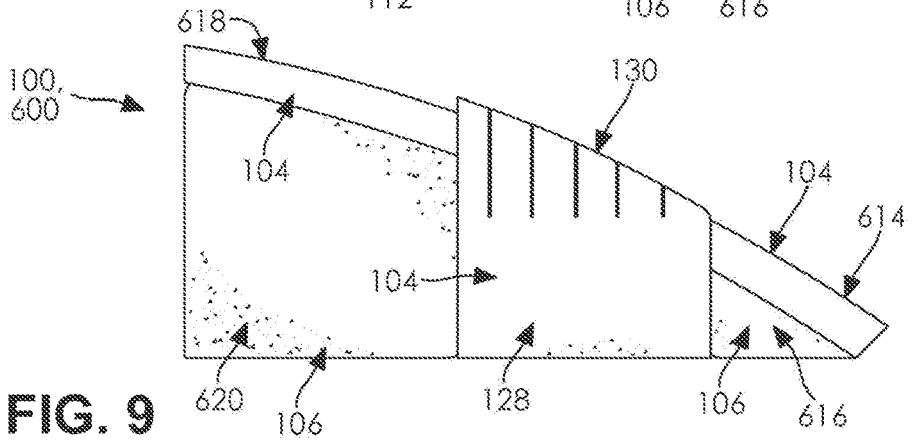
FIG. 9 is a left side elevational view of the upper torso support shown in FIG. 8, and further showing a first top layer, first body, second top layer, and second body.

As shown in FIGS. 8-9 and 10, a fifth embodiment of the customizable cushioning device 100 as an upper torso support 600 is shown. The upper torso support 600 can be configured to support and receive the anatomical region 101 of the patient, such as the upper torso, when the patient is in the supine position. In particular, the plurality of removable pillars 130 can be configured to support and receive the breasts of the patient. In some instances, the plurality of removable pillars 130 can be shaped to correspond and conform to the shape of the breasts of the patient. Specifically, an upper portion of the plurality of removable pillars 130 can include a first arch 602 and a second arch 604. The first arch 602 can be configured to correspond and conform to a right breast of the patient. The second arch 604 can be configured to correspond and conform to a left breast of the patient. Desirably, the first arch 602 and the second arch 604 of the plurality of removable pillars 130 can permit pressure redistribution. It should be appreciated a skilled artisan can select different shapes for the plurality of removable pillars 130, as desired.

The main body 102 of the upper torso support 600 can have a wedge shape with an upper torso incline 608. Desirably, the wedge shape and the upper torso incline 608 orientate the upper torso of the patient to permit pressure redistribution. The main body 102 of the upper torso support 600 can also include a first supporting structure 610 and a second supporting structure 612. The first supporting structure 610 can be disposed adjacent to the front side 120 of the main body 102. The second supporting structure 612 can be disposed adjacent to the rear side 118 of the main body 102. The plurality of removable pillars 130 and the intact base 128 can be disposed between the first supporting structure 610 and the second supporting structure 612. The first supporting structure 610 can have a first top layer 614 and a first body 616. The first top layer 614 can be disposed on the first body 616. The first body 616 can be generally wedge shaped. The second supporting structure 612 can have a second top layer 618 and a second body 620. The second top layer 618 can be disposed on the second body 620. The second body 620 can have a first receiving arched wall 622, a second receiving arched wall 624, and an upper torso void 626. The first receiving arched wall 622 can receive the first arch 602 of the plurality of removable pillars 130. The second receiving arched wall 624 can receive the second arch 604 of the plurality of removable pillars 130. The upper torso void 626 can be disposed in the rear side 118 of the main body 102 and the second body 620. The upper torso void 626 can be configured to receive the prone head support 200. Desirably, this can permit the patient to use the upper torso support 600 and the prone head support 200 simultaneously. In some examples, the upper torso void 626 can be shaped like a half-circle. However, it should be appreciated that the upper torso void 626 can be shaped differently, within the scope of this disclosure. The top surface 110 of the main body 102 can be defined by the first top layer 614, the second top layer 618, and the plurality of removable pillars 130. The upper torso incline 608 can be formed in the top surface 110. The upper torso incline 608 can provide an increasing thickness from the front side 120 to the rear side 118 of the main body 102.

The plurality of the removable pillars 130, the first top layer 614, and the second top layer 618 can be formed from the first portion 104 of the main body 102. The first body 616 and the second body 620 can be formed from the second portion 106 of the main body 102. The first flexibility of the first portion 104 can be greater than the second flexibility of the second portion 106. Desirably, the first flexibility being a higher flexibility can provide pressure redistribution for the anatomical region 101 of the patient. Also, it is believed that having the first body 616 and the second body 620 be a lower flexibility can assist the first body 616 and the second body 620 in supporting the upper torso of the patient. Also, the lower flexibility of the first body 616 and the second body 620 can militate against the plurality of removable pillars 130 of the plurality of removable pillars 130 from bending substantially past the first supporting structure 610 and the second supporting structure 612. In addition, the lower flexibility of the first body 616 and the second body 620 can assist in militating against the upper torso from sinking into the first body 616 and the second body 620.

In specific examples, the first IFD can be from 5 lbf to 35 lbf and the second IFD can be from 55 lbf to 85 lbf. The first density can be from 2.9 lb/ft$^3$ to 5.1 lb/ft$^3$ and the second density can be from 1.9 lb/ft$^3$ to 4.1 lb/ft$^3$. In more specific examples, the first IFD can be from 10 lbf to 30 lbf and the second IFD can be from 60 lbf to 80 lbf. The first density can be from 3.4 lb/ft$^3$ to 4.6 lb/ft$^3$ and the second density can be from 2.4 lb/ft$^3$ to 3.6 lb/ft$^3$. In even more specific examples, the first IFD can be from 15 lbf to 25 lbf and the second IFD can be from 65 lbf to 75 lbf. The first density can be from 3.9 lb/ft$^3$ to 4.1 lb/ft$^3$ and the second density can be from 2.9 lb/ft$^3$ to 3.1 lb/ft$^3$. It should be appreciated that one skilled in the art can scale the first IFD, the second IFD, the first density, and the second density, as desired. It should be also appreciated that at least one of the first portion 104 and the second portion 106 of the main body 102 can be comprised of memory foam, such as visco elastic foam.

With reference to FIG. 10, the above mentioned embodiments, including the prone head support 200, the upper torso support 600, and the lower torso support 500 can be provided in a prone positioning kit 700. In operation of the prone positioning kit 700, the prone head support 200, the upper torso support 600, and the lower torso support 500 can be arranged in a prone configuration 702 that permits the patient to be disposed across the prone head support 200, the upper torso support 600, and the lower torso support 500. Advantageously, the kit can be used to provide support for the head, the upper torso, and the lower torso of the patient, when the patient is in the prone position. It should be appreciated that one skilled in the art can select other embodiments to be included in the prone positioning kit 700. In addition, further kits that can include other embodiments are contemplated, within the scope of this disclose.

Figure 12:
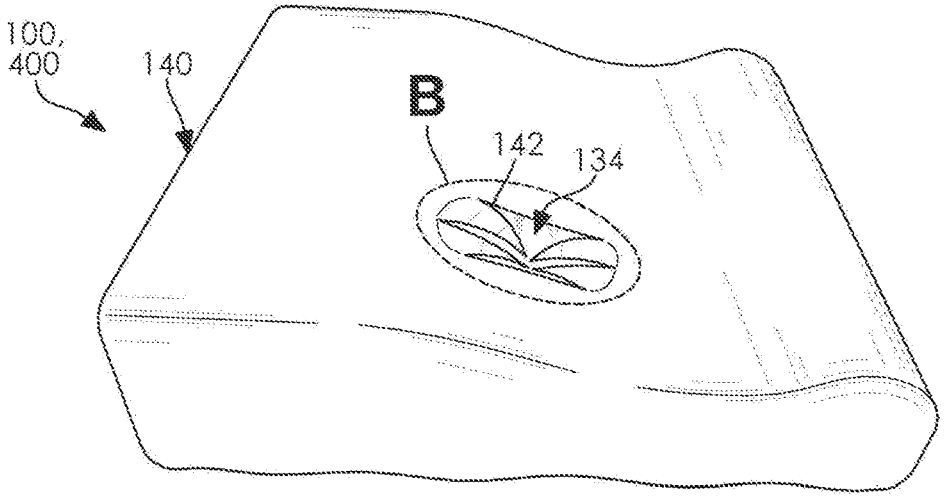
FIG. 12 is a top perspective view of the head support shown in FIG. 11 with a removable cover disposed over the head support, and further showing an aperture formed therein.

Now referencing FIG. 12, the customizable cushioning device 100 can further include a removable cover 140. The removable cover 140 can be configured to be disposed over the main body 102. Desirably, the removable cover 140 can protect the customizable cushioning device 100 from being contaminated. The removable cover 140 can be removed and washed. This can militate against the spread of infections and bacteria between different patients. While still referring to FIG. 12, the removable cover 140 can include an aperture 142. The aperture 142 can be configured to align and correspond with the conforming depression 134 when disposed over the customizable cushioning device 100. The aperture 142 can be further configured to receive the anatomical region 101 of the patient when disposed over the main body 102 of the customizable cushioning device 100. Desirably, the aperture 142 can militate against the force being applied to the anatomical region 101.

In some examples the removable cover 140 can be manufactured from moisture wicking fabric. Desirably, the moisture wicking fabric aids in wicking excess moisture from the anatomical region 101 of the patient. Non-limiting examples include synthetic fibers, such as polyester or nylons. It should be appreciated that a skilled artisan can select other fabrics for the removable cover 140, within the scope of this disclosure.

Figure 11:
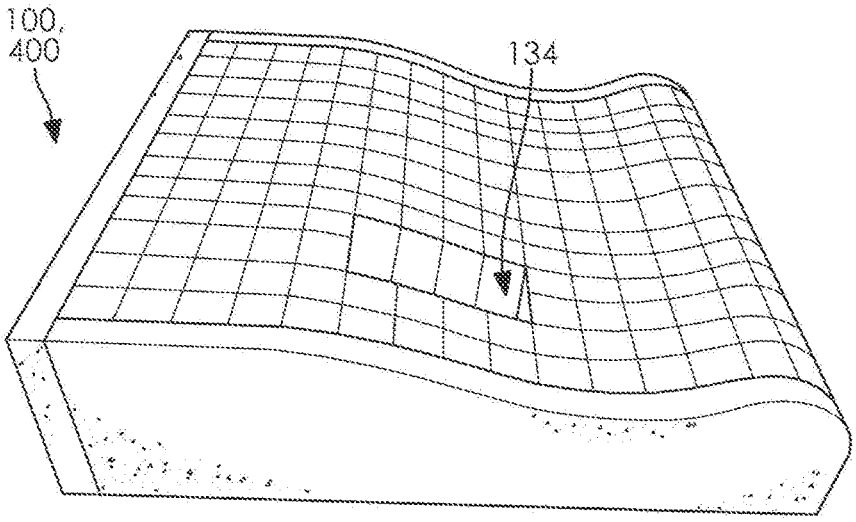
FIG. 11 is a top perspective view of the head support shown in FIG. 3 with a portion of the plurality of removable pillars removed, and further showing a conforming depression.

With reference to FIGS. 11-13 and 14, a method for supporting an anatomical region 101 of a patient is shown. The method 800 includes a step 802 of providing the customizable cushioning device 100. Then, as shown in FIG. 11, the portion of the plurality of removable pillars is removed to form the conforming depression 134 in the plurality of the removable pillars, in a step 804. As mentioned above, the conforming depression 134 can be configured to accommodate contours of the anatomical region 101 of the patient. Desirably the step 804 prepares the customizable cushioning device 100 to be used to support and receive the anatomical region 101 of the patient. Next, in a step 806, the anatomical region 101 of the patient is selectively disposed on the customizable cushioning device 100, whereby the anatomical region 101 of the patient is received by the conforming depression 134, shown in FIG. 13.

The method 800 can also include a step 808 of providing the removable cover 140 for the customizable cushioning device 100. Then, as shown in FIG. 12, the removable cover 140 can be selectively disposed over the customizable cushioning device 100, in a step 810. Next, in a step 812, the removable cover 140 is selectively perforated to create the aperture 142. As mentioned previously, the aperture 142 can align and conform with the conforming depression 134 in the top surface 110 of the main body 102. Then, the step 806 includes the anatomical region 101 of the patient being selectively disposed on the customizable cushioning device 100, shown in FIG. 13, whereby the anatomical region 101 of the patient is received by both the aperture 142 of the removable cover 140 and the conforming depression 134 of the main body 102.

Advantageously, the first portion 104 and the second portion 106 of the main body 102 permits the customizable cushioning device 100 to have variable flexibility. It is believed, without being bound to a particular theory, that the variable flexibility can lead to more optimized pressure redistribution. In addition, the removable cover 140 can militate cross-contamination between patients, while still allowing the anatomical region 101 to reach the conforming depression 134 via the aperture 142 of the removable cover 140.

While certain representative embodiments and details have been shown for purposes of illustrating the invention, it will be apparent to those skilled in the art that various changes can be made without departing from the scope of the disclosure, which is further described in the following appended claims.

What is claimed is:

1. A customizable cushioning device for supporting an anatomical region of a patient, comprising:

a main body having an intact base and a plurality of removable pillars disposed on the intact base, the main body including a first portion and a second portion, the first portion having a first flexibility, the second portion having a second flexibility, the first flexibility being different from the second flexibility;

wherein:

a portion of the plurality of removable pillars is configured to be removed to form a conforming depression configured to accommodate the anatomical region of the patient;

the main body includes a first supporting structure and a second supporting structure, the plurality of removable pillars and the intact base are disposed between the first supporting structure and the second supporting structure;

the first supporting structure has a first top layer and a first body, the second supporting structure has a second top layer and a second body, and the main body has a top surface defined by the first top layer, the second top layer, and the plurality of removable pillars; and the first top layer, the second top layer, and the plurality of removable pillars are formed from the first portion of the main body, and the first body and the second body are formed from the second portion of the main body.

2. The customizable cushioning device of claim 1, wherein the main body is formed from foam.

3. The customizable cushioning device of claim 1, wherein main body includes a backing layer, the backing layer disposed underneath the intact base.

4. The customizable cushioning device of claim 3, wherein the main body has a top surface, a majority portion of the top surface defined by the plurality of removable pillars.

5. The customizable cushioning device of claim 4, wherein the plurality of removable pillars is formed from the first portion of the main body, and the backing layer is formed from the second portion of the main body.

6. The customizable cushioning device of claim 5, wherein each of the removable pillars has a top pillar surface, a side pillar surface, and a rounded pillar transition between the top pillar surface and the side pillar surface.

7. The customizable cushioning device of claim 3, wherein the plurality of removable pillars forms a middle region, a left plurality of pillars forms a left region, and a right plurality of pillars forms a right region, the middle region disposed between the left region and the right region, and wherein each of the left region and the right region, and the backing layer are formed from the second portion of the main body, and the middle region is formed from the first portion of the main body.

8. The customizable cushioning device of claim 7, wherein main body includes a frame formed from the second portion of the main body, and the frame is configured to partially surround the main body.

9. The customizable cushioning device of claim 3, wherein the backing layer has a first backing region, a second backing region, and a third backing region, the second backing region is disposed between the first backing region and the third backing region, and each of the first backing region and the third backing region not being disposed underneath the plurality of removable pillars.

10. The customizable cushioning device of claim 9, wherein a top surface is defined by the first backing region, the third backing region, and the plurality of removable pillars.

11. The customizable cushioning device of claim 10, wherein each of the first backing region, the second backing region, and the third backing region is formed from the second portion of the main body, and the plurality of removable pillars is formed from the first portion of the main body.

12. The customizable cushioning device of claim 1, further comprising a removable cover disposed over the main body, and the removable cover has an aperture configured to receive the anatomical region of the patient.

13. A method for supporting an anatomical region of a patient, comprising the steps of:

Providing a customizable cushioning device including a main body having an intact base and a plurality of removable pillars disposed on the intact base, the main body including a first portion and a second portion, the first portion having a first flexibility, the second portion having a second flexibility, the first flexibility being different from the second flexibility;

wherein:

a portion of the plurality of removable pillars is configured to be removed to form a conforming depression configured to accommodate the anatomical region of the patient;

the main body includes a first supporting structure and a second supporting structure, the plurality of removable pillars and the intact base are disposed between the first supporting structure and the second supporting structure;

the first supporting structure has a first top layer and a first body, the second supporting structure has a second top layer and a second body, and the main body has a top surface defined by the first top layer, the second top layer, and the plurality of removable pillars; and the first top layer, the second top layer, and the plurality of removable pillars are formed from the first portion of the main body, and the first body and the second body are formed from the second portion of the main body;

and selectively removing a portion of the plurality of removable pillars to form a conforming depression in the plurality of removable pillars, the conforming depression configured to accommodate contours of the anatomical region of the patient.

14. The method of claim 13, further including a step of selectively disposing the anatomical region of the patient onto the customizable cushioning device, whereby the anatomical region of the patient is received by the conforming depression.

15. The method of claim 13, further including a step of providing a removable cover, a step of selectively disposing the removable cover over the customizable cushioning device, and a step of selectively perforating the removable cover to create an aperture that aligns with the conforming depression in the plurality of removable pillars of the main body.

16. The method of claim 15, further including a step of selectively disposing the anatomical region of the patient onto the customizable cushioning device, whereby the anatomical region of the patient is received by both the aperture of the removable cover and the conforming depression of the main body.

* * * * *